United States Patent [19]

Petz

[11] Patent Number: 4,917,374

[45] Date of Patent: Apr. 17, 1990

[54] TRANSPORTABLE POWER DRIVEN CAROUSEL

[76] Inventor: Peter Petz, Sredlungsstra Be 44, 8891 Sulzbach-Aichach, Fed. Rep. of Germany

[21] Appl. No.: 309,594

[22] Filed: Feb. 13, 1989

[30] Foreign Application Priority Data

Feb. 12, 1988 [DE] Fed. Rep. of Germany ... 8801883[U]
Aug. 6, 1988 [DE] Fed. Rep. of Germany ... 8810076[U]

[51] Int. Cl.[4] ..... A63G 1/00

[52] U.S. Cl. ..... 272/29; 272/48; 272/47

[58] Field of Search ..... 272/29, 48, 47

[56] References Cited

U.S. PATENT DOCUMENTS 573,577 12/1896 Dentzel ..... 272/47
630,003 8/1899 Olson et al. ..... 272/47
864,245 8/1907 Hutchinson ..... 272/47
1,302,088 4/1919 Prior et al. ..... 272/48
3,468,533 9/1969 House, Jr. ..... 272/29 X

*Primary Examiner*—Richard E. Chilcot, Jr.
*Attorney, Agent, or Firm*—Sixbey, Friedman, Leedom & Ferguson

[57] ABSTRACT

An improved transportable power-operated carousel of the type having a minimum of two concentric rotating tier-like platforms, a central mast with a rotating hub and radial arms arranged in a spoke-like manner at the hub for suspending the rotating platforms; wherein the improvement comprises L-shaped angled support arms having a first leg extending upwardly from the hub in an operating position, and a second leg adjacent thereto which, in an operating condition is approximately horizontal, the arms being vertically as well as horizontally pivotally connected with the hub.

10 Claims, 3 Drawing Sheets

TRANSPORTABLE POWER DRIVEN CAROUSEL

TECHNICAL FIELD

The invention relates to a carousel and is specifically concerned with a two-tier carousel that is collapsible to an easily transportable size.

BACKGROUND OF THE INVENTION

It is known to construct a carousel having two levels, i.e. having two tier-like, concentric, commonly rotating platforms, arranged one above the other. Typically, the two platforms are suspended by overhead horizontal support arms, which are mounted radially, in a spoke-like manner onto a rotating hub formed from a central mast of corresponding height. The height of the double-tiered carousel is determined by the stacked arrangement of the two rotating platforms, with the upper platform being high enough to accomodate the required amount of head room and safety clearance between both the lower rotating platform and the upper rotating platform, as well as the amount of clearance needed between the upper rotating platform and the radial support arms overhead.

It is also known to mount transportable carousels onto undercarriages, and to this end rotating platform segments have been designed that are disposed at both sides of the longitudinal undercarriage axis such that they are foldable into an approximately vertical transport position. Platform segments have also been designed that are removable for rendering the carousel transportable without extensive disassembly, by bringing it to a width which meets the requirements of over the road transport. Such a collapsed carousel may be transported by hitching it to a tractor type vehicle.

Simpler carousels with only a single rotating platform permit such manner of transport and reassembly after transport relatively quickly and easily. However, the transport of conventional double-tiered carousels is complicated by their heights which exceed the usual clearances of bridges and underpasses and make them subject to too high a center of gravity during transport. Accordingly, in order to transport such conventional double-tiered carousels, it is necessary to disassemble their radial support arms, and at least partially disassemble the mast and the struts to comply with height requirements. Thus, with each location change extensive assembly and reassembly much work is required, which, as experience has shown, takes several days.

SUMMARY OF THE INVENTION

It is the objective of the present invention to construct a double-tiered carousel, or a carousel having rotating platforms arranged on at least two levels, in such a manner as to substantially reduce the amount of assembly and disassembly work required for location changes.

In accordance with the invention, this objective is achieved by the provision of support arms which are pivotally movable both downwardly and from side-to-side with respect to the hub.

The inventive design permits that in a double-tiered carousel, the hub is arranged at approximately the height of the upper platform, i.e. only approximately at floor height above the lower platform, and the L-shaped angled support arms in between their operating position—in which the approximately horizontal legs are again at about floor height above the upper platform—are vertically downwardly pivotable into a transport position, in which the legs directed upwardly in the operating position are approximately horizontal, and the legs which in their operating position are approximately horizontal, project downwardly. Moreover, the support arms are horizontally pivotally movable with respect to the hub, so that the support arms can be pivoted into a transport position which is approximately parallel with the longitudinal axis of the undercarriage so that approximately half of the support arms point rearwardly, and the other half of the support arms point forwardly.

Accordingly, the inventive construction has the advantage that the support arms, in their transition from the operating position into the travel position, do not have to be removed from the hub or disassembled, but after removal of appropriate locking mechanisms, by a horizontal side-to-side pivoting, are brought into a position which is approximately parallel to the longitudinal axis of the undercarriage, and by a vertical downward pivoting are brought into their transport position. The transition from the transport position into the operating position is carried out correspondingly. No assembly work is necessary at the mast itself, except for the movement of the vertical mast extension which customarily anchors the support arms, which mast extension is also present in conventional double-tiered carousels and does not present any problem. In the inventive construction, the actual part of the mast that transfers the carousel drive to the platforms has only a relatively low height which does not cause difficulties in the passage of bridges and underpasses.

Thus, the carousel design in accordance with the invention permits a much easier location change than is possible with the conventional double-tiered carousel construction since the assembly work necessary for establishing transportability and reestablishing operatibility of the inventive carousel is much shorter than the tim e required by conventional carousel designs, which improves the ratio of actual operation time versus time spent for reconstruction and transport and, inherently, substantially improves the economic yield of the carousel operation.

BRIEF DESCRIPTION OF THE SEVERAL FIGURES

An example of the invention is schematically depicted in the appended drawings and is briefly described below. The drawings show:

FIG. 1 A side view of the carousel

FIG. 2 A top view onto the hub with radial support arms

FIG. 3 A front view of the carousel brought into its transport position, and

FIG. 4 A variation of the upper portion of the carousel depicted in FIG. 1, having a third rotating platform (three-tiered carousel)

For reasons of clarity, the drawings eliminate all unnecessary and conventional details.

DETAILED DESCRIPTION OF THE PREFERRED EMBODIMENT

Figure 1:
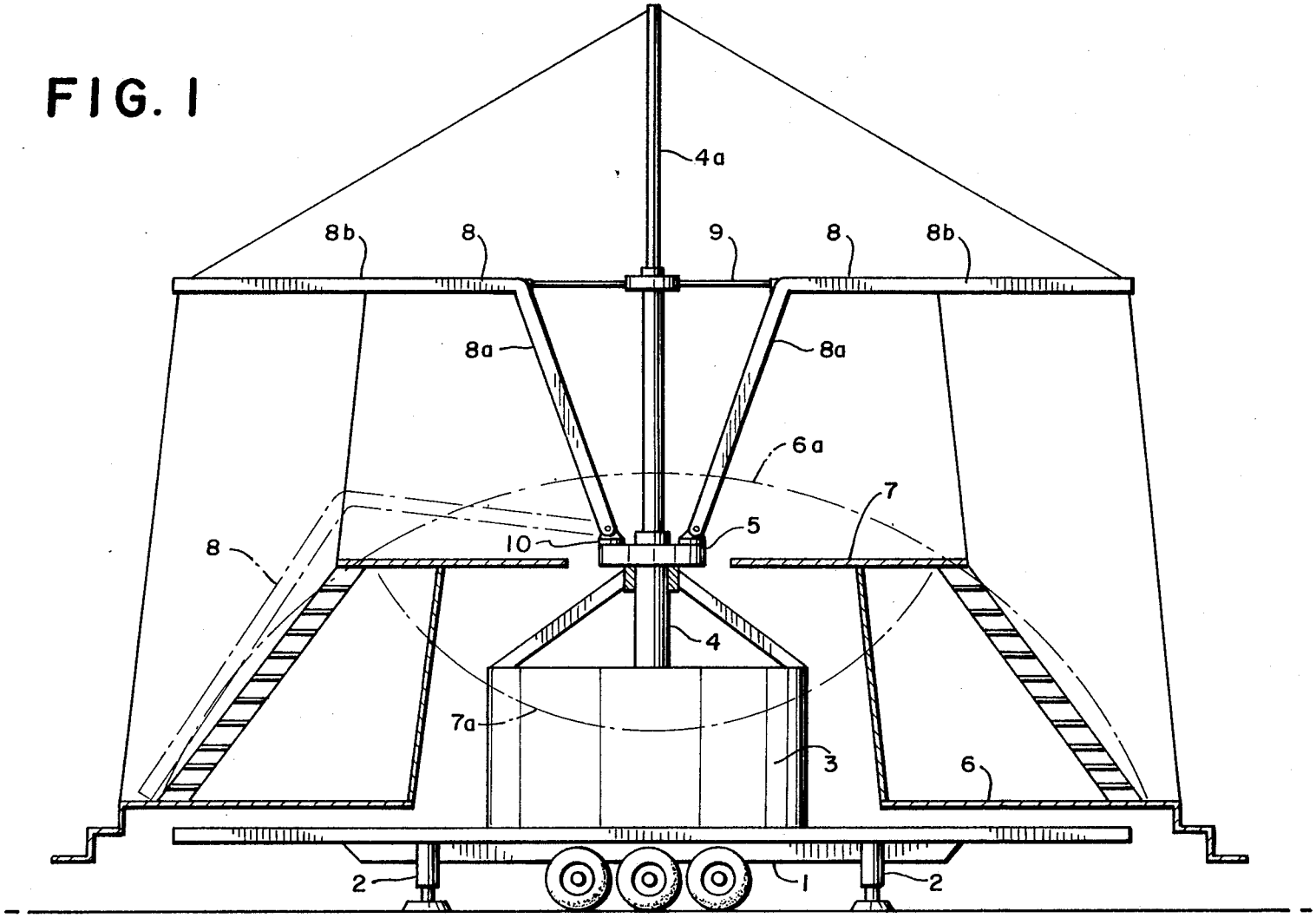

FIG. 1 depicts a side view of the carousel while in operating condition. The carousel is mounted on an undercarriage 1 with corresponding supports 2. The drive unit 3 of the carousel includes a rotational by driven mast 4 that is mounted onto undercarriage 1. The two-tiered carousel has two concentric rotating platforms, i.e. a lower rotating platform 6 and an upper rotating platform 7 which can be connected with each other by struts, stairs, etc., and which are jointly suspended by support arms 8. Support arms 8 are L-shaped angled arms, each of which has an upwardly directed leg 8*a* and a horizontal leg 8*b*, each leg being connected with hub 5. In the operation of the carousel, the rotating platforms 6 and 7 are simultaneously caused to rotate via support arms 8 radially extending in a spoke-like manner from hub 5.

In their operating positions, support arms 8 are braced by horizontal tie rods 9 which are aligned with the approximately horizontal legs 8*b*, and are further tensioned with the tip of the mast extension by way of guy wires.

Figure 2:
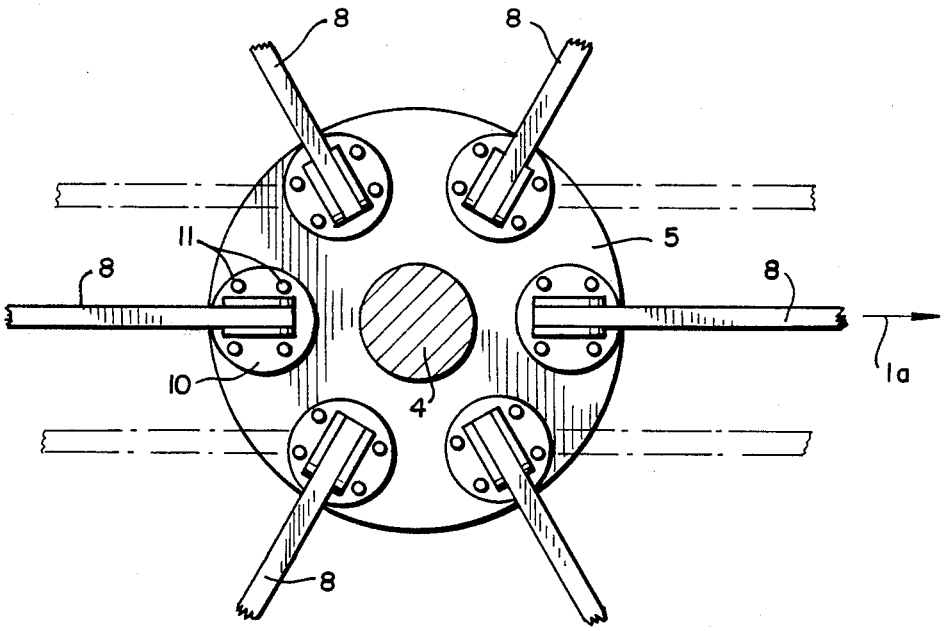

The support arms 8 are pivotally connected to the hub 5, and are vertically as well as horizontally pivotable, permitting these support arms to be brought into a collapsed travel position approximately parallel to the undercarriage axis for transport of the carousel. Such transportation position is indicated in FIGS. 1 and 2 by dash-dotted lines. In this connection, FIG. 1 depicts how the support arms 8 are folded down into the transport position, and FIG. 3 shows how three of the six spoke-like support arms 8 are horizontally pivoted into a rearwardly directed position, and the remaining three arms are pivoted into a forwardly directed position relative to the longitudinal axis of the undercarriage as indicated in the drawing by arrow 1*a*.

The assembly of support arms 8 at hub 5 is by way of hinged assembly group 10, not depicted in detail, which, together with hub 5 forms a rotating link with the vertical axis of rotation to which support arms 8 are pivotally connected via a hinged link with horizontal rotational axis. Hinged assembly group 10 with hub 5, as well as the hinged assembly group with support arms 8, may have contacting flange components with bolts for the locking of the corresponding links when the support arms are in their operating position. Such bolts, for example, are indicated in FIG. 2 at numeral 11 between hinged assembly group 10 and hub 5. As can be easily perceived, other means can be used for locking support arms 8 into their operating or transport positions. Mast 4 is preferably a telescoping mast, permitting mast extension 4*a* to be slidably moved in and out, thereby allowing the height of the mast 4 to be contracted to the level of the hub 5 during transport.

Figure 3:
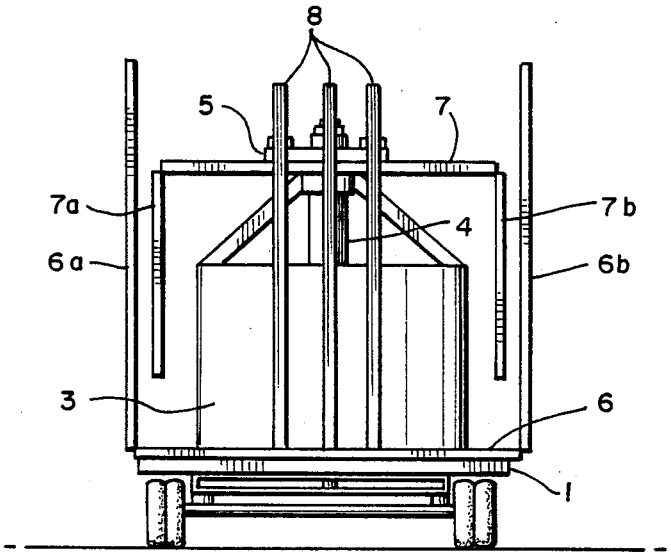

As particularly shown in FIG. 3, the two rotating platforms 6 and 7 have hinged segments 6*a*, 6*b* or 7*a*, 7*b*, arranged at both sides of the longitudinal undercarriage axis, whereby segments 7*a*, 7*b* of upper rotating platform 7 can be folded downwardly and segments 6*a*, 6*b* of the lower rotating platform 6 can be folded upwardly into an approximately vertical transport position, as depicted in FIG. 3. In the lateral view of FIG. 1, the segments being folded down or up into their transport positions are indicated by dash-dotted lines.

In its transport condition, with the support arms 8 folded under and pivoted parallel to the longitudinal undercarriage axis, and with the rotating platform segments being folded downwardly or upwardly, the carousel has a width which is permissible for road transport and a height of approximately 3 meters, so that it can be hooked-up to a tractor type vehicle, and will clear bridges and underpasses of less than average height. For clarity, the means necessary for securing the rotating platform to the undercarriage when in the transport condition are not depicted in FIG. 1.

The same design principle can be applied to set up carousels with more than two rotating platforms, having, for instance, a third rotating platform arranged as an intermediate tier.

Figure 4:
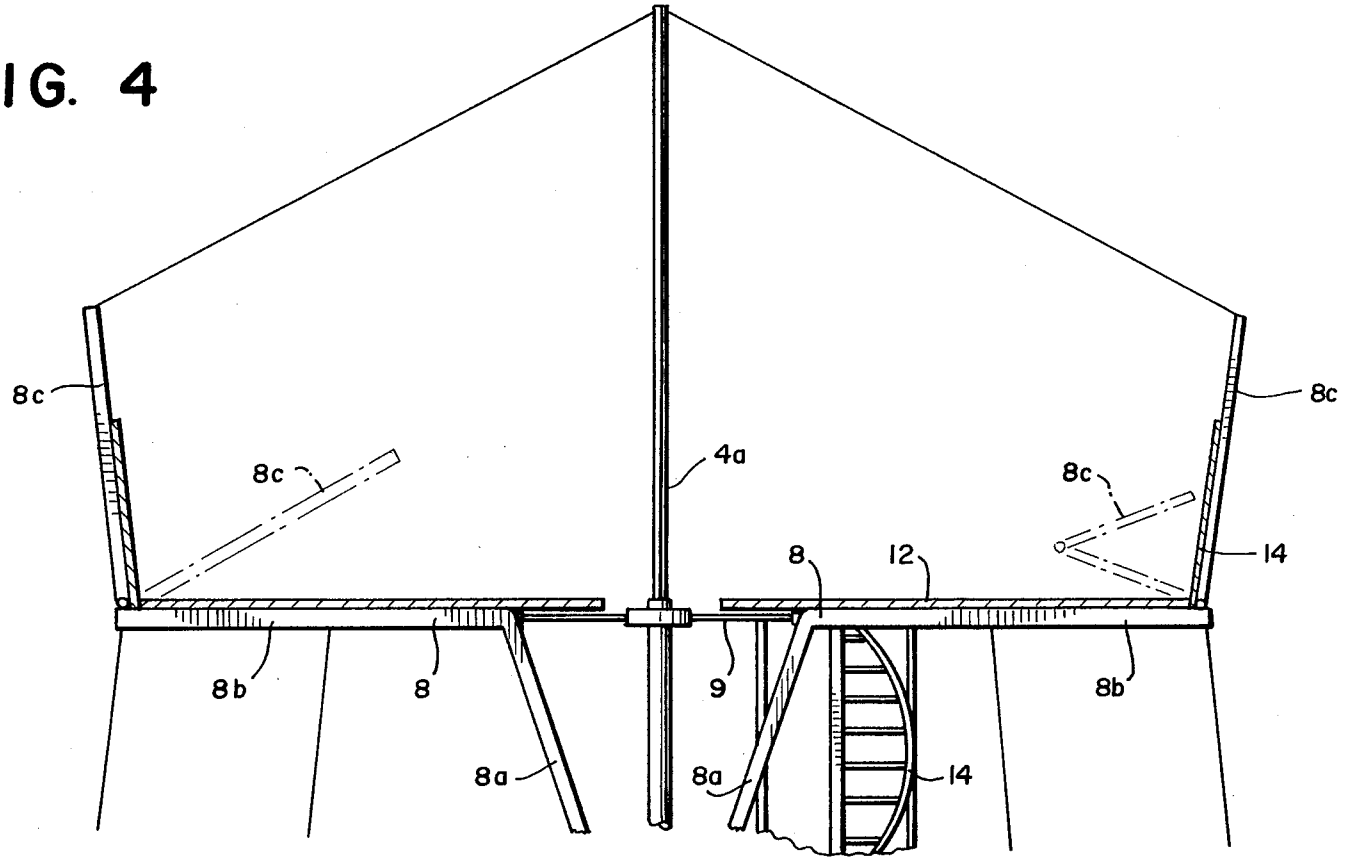

Based on the above design principle, a three-tiered carousel also can be constructed such that a carousel according to FIGS. 1 to 3 having two rotating platforms below arms 8, has a third rotating platform placed onto the arms 8 brought into their operating position, as depicted in FIG. 4.

Accordingly, a third rotating platform 12 is placed onto the horizontal legs 8*a* of arms 8 which have been brought into their operating position. Appropriately, this third rotating platform 12 consists of two or three elements which can be removed for transport, and connection with the second rotating platform 7 there below may be by one, or, possibly by two circular staircases in the radial inner area. The circular staircase 13 is constructed as a one-piece structural element which is simply installed between the second and the third rotating platform and is again removed for dismantling of the carousel.

For reasons of safety, the third rotating platform 12 has a boundary wall 14 secured at wall struts 8*c*. These wall struts 8*c* are hingeably connected to the radial outer ends of horizontal legs 8*b* of arms 8 and are tiltable between their FIG. 4 operating position and the transport position in which they lie against the horizontal legs 8*b* of arms 8.

To this end, as indicated in FIG. 4 by dash-dotted lines, the wall struts 8*c* can either be formed as a straight rod which can be tilted around the hinge axis at the horizontal leg 8*a* of the corresponding arm 8 (left-hand representation in FIG. 4), or, alternatively, may consist of two hingeably connected knee-lever-like sections (right-hand representation in FIG. 4) which in the transport position are folded one over the other.

Naturally, the mast extension 4*a* of such a three-tiered carousel is of corresponding length so as to serve as the tent's roof carrier, together with the boundary wall 14 and the guy wires between wall struts 8*c*.

I claim:

1. An improved transportable poweroperated carousel comprising a minimum of two concentric rotating tier-like platforms, a central mast with a rotating hub and radially oriented support arms arranged in a spoke-like manner from the hub for suspending the rotating platforms; wherein said support arms are L-shaped angled support arms including a first leg extending upwardly from the hub in an operating position, and a second leg adjacent thereto which, in an operating position, assumes a substantially horizontal orientation the arms being pivotally connected with the hub.

2. A carousel according to claim 1, wherein said carousel is mounted on an undercarriage.

3. A carousel according to claim 1, wherein the mast includes a removable, telescoping top portion for supporting the support arms when they are in said operating position.

4. A carousel according to claim 1, further comprising tie rods for bracing said second leg of the arms in said substantially horizontal orientation.

5. A carousel according to claim 1, further comprising horizontal and vertical rotational links between the hub and the arms having cooperating flange components and a locking means for securing the arms in said operating position.

6. A carousel according to claim 1, wherein the lower platform includes opposing segments that are upwardly foldable, and the upper platform includes opposing segments that are downwardly foldable into a transport position.

7. A carousel according to claim 6, wherein the hub is disposed approximately at the height of the upper platform, and the length of the upwardly extending legs corresponds approximately to the radius of the upper rotating platform.

8. A carousel according to claim 1, including a third detachable platform supported by the first legs of the arms when said arms are in their operating position, wherein each of said arms has a free outer end.

9. A carousel according to claim 8, including wall struts that are hingedly connected at the free outer ends of the second legs of the arms, and are pivotable into a transport position in which they rest against the second legs, and into an upwardly tilted operating position, approximately at right angles to said second legs, said struts further being foldable for securing the third rotating platform and for mounting a boundary wall.

10. A carousel according to claim 9, wherein each wall strut includes two hingedly connected segments, which are folded in a transport position and extended in an operating position.

* * * * *